US007479976B2

(12) United States Patent
Ehmann

(10) Patent No.: US 7,479,976 B2
(45) Date of Patent: Jan. 20, 2009

(54) REVERSED THERMAL HEAD PRINTING

(75) Inventor: Michael J. Ehmann, Geneseo, NY (US)

(73) Assignee: Eastman Kodak Company, Rochester, NY (US)

( * ) Notice: Subject to any disclaimer, the term of this patent is extended or adjusted under 35 U.S.C. 154(b) by 247 days.

(21) Appl. No.: 11/342,788

(22) Filed: Jan. 30, 2006

(65) Prior Publication Data

US 2007/0176999 A1 Aug. 2, 2007

(51) Int. Cl.
*B41J 2/325* (2006.01)

(52) U.S. Cl. ..... 347/215

(58) Field of Classification Search ..... 347/215, 347/171, 175, 197, 198, 218, 220; 400/120.03, 400/120.17

See application file for complete search history.

(56) References Cited

U.S. PATENT DOCUMENTS 4,661,824 A 4/1987 Kuge
5,176,458 A 1/1993 Wirth
5,196,863 A 3/1993 Palmer et al.
5,441,353 A 8/1995 Kim
5,499,880 A 3/1996 Pickering et al.
5,868,382 A 2/1999 Groves
5,918,990 A * 7/1999 Abumehdi ..... 400/120.17
6,328,407 B1 12/2001 Sengun
2006/0232656 A1 * 10/2006 Mindler et al. ..... 347/171

* cited by examiner

*Primary Examiner*—K. Feggins
(74) *Attorney, Agent, or Firm*—Roland S. Schindler II

(57) ABSTRACT

A printer and method for operating a printer are provided. The printer has a printhead adapted to heat a thermal donor medium to transfer donor material from a donor web to a receiver medium; a receiver medium path having guides shaped to direct receiver medium along a receiver medium travel path to and from a position in registration with the printhead with said receiver medium path having at least one change of receiver medium direction therein causing said receiver medium to bend; and a motorized platen for moving receiver medium through the receiver medium path, wherein said receiver medium path is further shaped so that the change in receiver medium direction occurs in a portion of the receiver medium path that takes the receiver medium from a position in registration with the printhead.

13 Claims, 5 Drawing Sheets

REVERSED THERMAL HEAD PRINTING

FIELD OF THE INVENTION

This invention relates in general to printers and methods of printing and in particular to methods of borderless printing.

BACKGROUND OF THE INVENTION

A key component of a conventional thermal dye transfer printer is the thermal printhead. In many thermal printers, the thermal printhead has a ceramic substrate side and a circuit board side bonded together to an aluminum backer plate. The ceramic substrate side has a plurality of heating elements (heater line) for transferring dye from a ribbon onto paper. The circuit board has integrated circuits laterally spaced from the ceramic substrate on the bottom and connectors on the top to supply power and data for selectively operating the heating elements. In some printers, the integrated circuit is enclosed in a protective housing that has two walls and a cover between the walls, with one wall distal from the ceramic substrate and transverse to the substrate and the other wall proximate to the ceramic substrate and varying in height from a minimal level proximate the level of the substrate to a maximum level of the cover. Alternatively, in other printers the integrated circuit is covered by a junction coated resin to protect the integrated circuit.

In a conventional thermal printer, a receiver medium 12, such as a paper, fabric, film, or other web or sheet type material, is clamped between a capstan roller and a pinch roller and pulled through a nip between the thermal printhead and the platen. The capstan and pinch rollers are driven by a stepper motor that provides both precise movement and control of the paper sheet. The printhead and platen capture a web of donor material with dye and press it against the paper. In some printers the platen spins freely while the web and receiver are pulled past the printhead and in other printers the platen is driven. Heat from the thermal head transfers dye from the donor web onto the receiver medium to create an image.

Using this process, thermal dye transfer printers create continuous tones of specific colors not unlike those of traditional color photo prints. Whereas traditional color photos use dyes and fine grains of silver salts, chemically processed to produce an image, thermal printers achieve continuous tones by laying their cyan, yellow and magenta dyes on top of each other with repeated passes of the paper past the printhead. (Some thermal printers also add black dye to the final process). Thermal dye transfer printers also have the capacity to use their heat provided by the printhead to seal a clear plastic layer over the completed print giving the final product an estimated 100-year lifespan.

An example of a conventional thermal dye transfer printer that provides monotone, multi-tone or full color printing is shown in FIG. 1. Conventional printer 10 has a sheet of receiver medium 12 that is driven along a print path 14 by capstan roller 16 and pinch roller 18. A printhead 20 is opposite a free spinning platen 22. Donor supply roller 24 and donor take up roller 26 support a web 28 of thermal dye donor material. A bias spring 30 presses printhead 20 against donor web 28 that contacts receiver medium 12. A pinch spring 32 urges pinch roller 18 against capstan roller 16. Capstan roller 16 is turned by a stepper motor 34. A belt 36 connects the capstan roller 16 to stepper motor 34. A leading edge of the receiver medium 12 is fed through a feed nip 38 between capstan roller 16 and pinch roller 18 so that receiver medium 12 and donor web 28 are pulled past the printhead 20 and platen 22 where donor material is transferred to receiver medium 12.

As illustrated, conventional printer 10 has printhead 20 normally positioned with an integrated circuit cover 40 extending into the plane of the print path. As such, receiver medium 12 must be turned to bend beneath integrated circuit cover 40. Whenever receiver medium 12 is deflected from a straight path and must be curved or bent to travel along a bent path, there is a higher likelihood that receiver medium 12 will be diverted from the precise alignment required of a receiver medium 12 during thermal printing. This can cause variations in registration that can create unwanted image artifacts. Thus, what is needed is a thermal printer having more easily established registration.

SUMMARY OF THE INVENTION

In various aspects of the invention, a method for printing and a printer are provided.

In one aspect of the invention, a method for operating a printer is provided. The printer has a printhead moveable toward and away from a platen. The printhead comprises a ceramic substrate for holding a plurality of heating elements and, an integrated circuit laterally spaced from the ceramic substrate and connected to the heating elements for selectively operating the heating elements. In accordance with the method, the receiver medium is moved along the path toward the printhead and the platen; the printhead is moved toward the donor web to clamp the receiver medium between the donor web and the platen and the platen is moved with respect to the printhead to advance the receiver medium and the donor web past the printhead in a direction where the donor web and receiver medium pass the ceramic substrate and thereafter pass the integrated circuit. Portions of the printhead are selectively energized to transfer donor material from the donor web to the receiver medium during the movement.

In another aspect of the invention, a printer is provided having a printhead moveable toward and away from a platen. The printhead comprises a ceramic substrate for holding a plurality of heating elements and, an integrated circuit laterally spaced from the ceramic substrate and connected to the heating elements for selectively operating the heating elements; a platen for receiving and carrying a receiver medium past the printhead; a donor web disposed between the printhead and the receiver medium; a sheet feeder for moving the receiver medium toward the platen to register the receiver medium with the donor web; and a motor coupled to the platen for operating the platen to drive the receiver medium and the donor web during printing in a direction from the ceramic substrate toward the integrated circuit.

In yet another aspect of the invention, a printer is provided having a printhead moveable toward and away from a platen. The printhead comprises a ceramic substrate for holding a plurality of heating elements and an integrated circuit laterally spaced from the ceramic substrate and connected to the heating elements for selectively operating the heating elements. A donor web is disposed between the printhead and the receiver medium. A transport path is shaped to guide receiver medium toward the platen to register the receiver medium with the donor web A movable platen advances the receiver medium and the donor web along the transport path during printing in a direction from the ceramic substrate toward the integrated circuit.

In still another aspect of the invention, a thermal printer is provided. The thermal printer comprises: a printhead adapted to heat a thermal donor medium to transfer donor material from a donor web to a receiver medium; a receiver medium path having guides shaped to direct receiver medium along a receiver medium travel path to and from a position in registration with the printhead with the receiver medium path having at least one change of receiver medium direction therein causing the receiver medium to bend; and a motorized platen for moving receiver medium through the receiver medium path, wherein the receiver medium path is further shaped so that the change in receiver medium direction occurs in a portion of the receiver medium path that takes the receiver medium from a position in registration with the printhead.

DETAILED DESCRIPTION OF THE INVENTION

Figure 1:
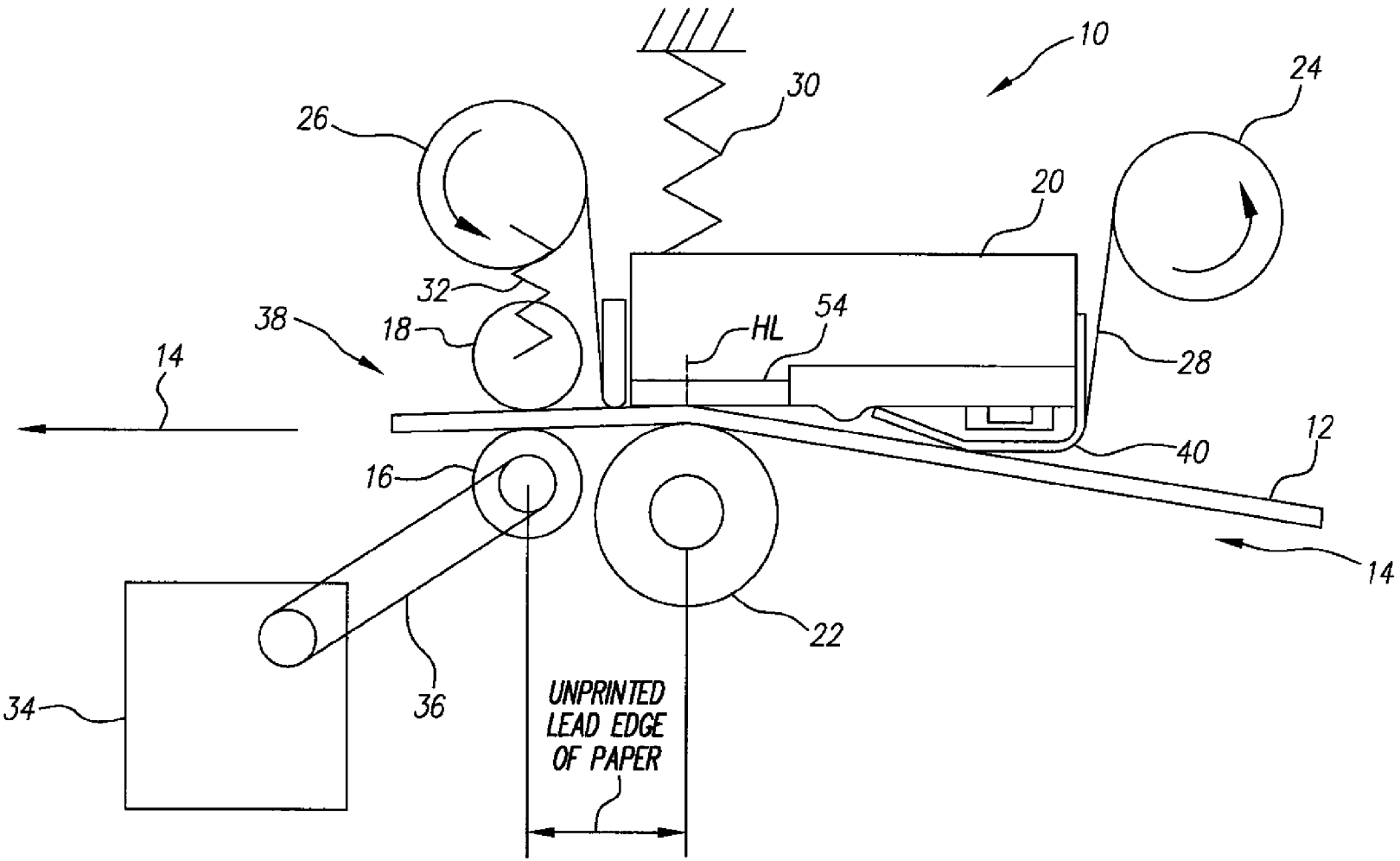
FIG. 1 (Prior Art)
FIG. 1 is a mechanical schematic of a conventional thermal printer with capstan/pinch drive rollers.
Figure 2:
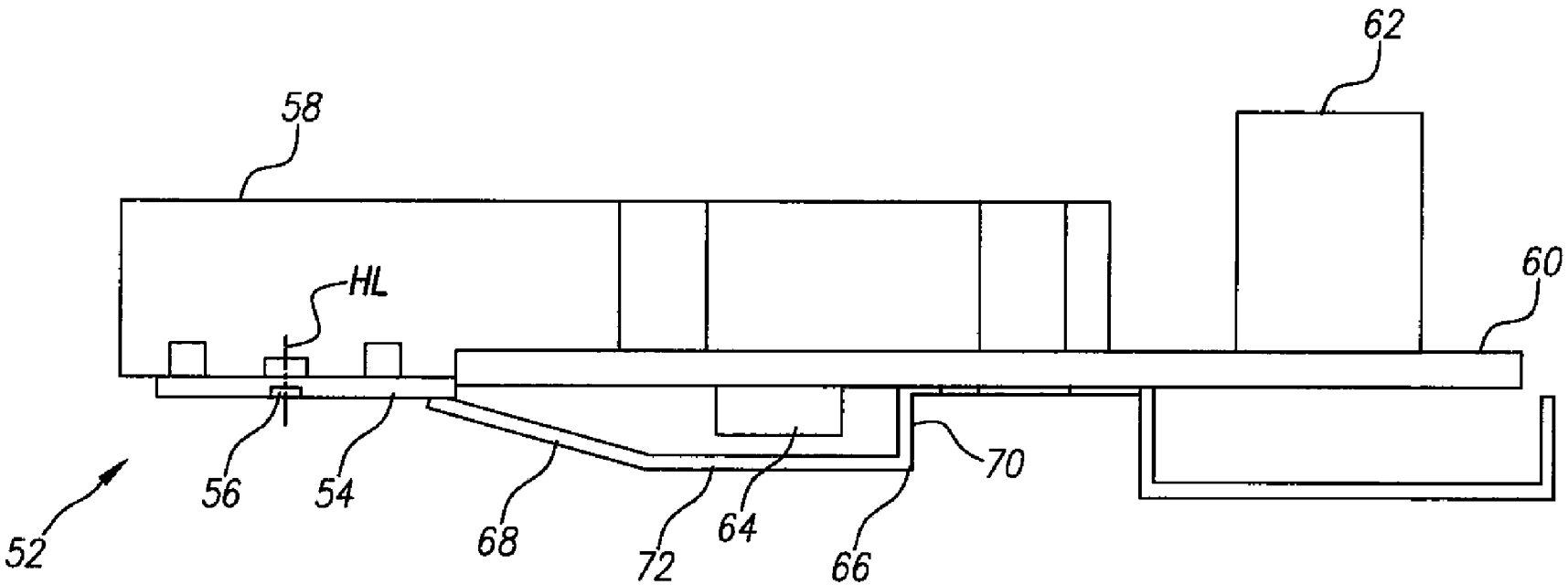
FIG. 2 is a mechanical schematic view of a thermal printhead.
Figure 3:
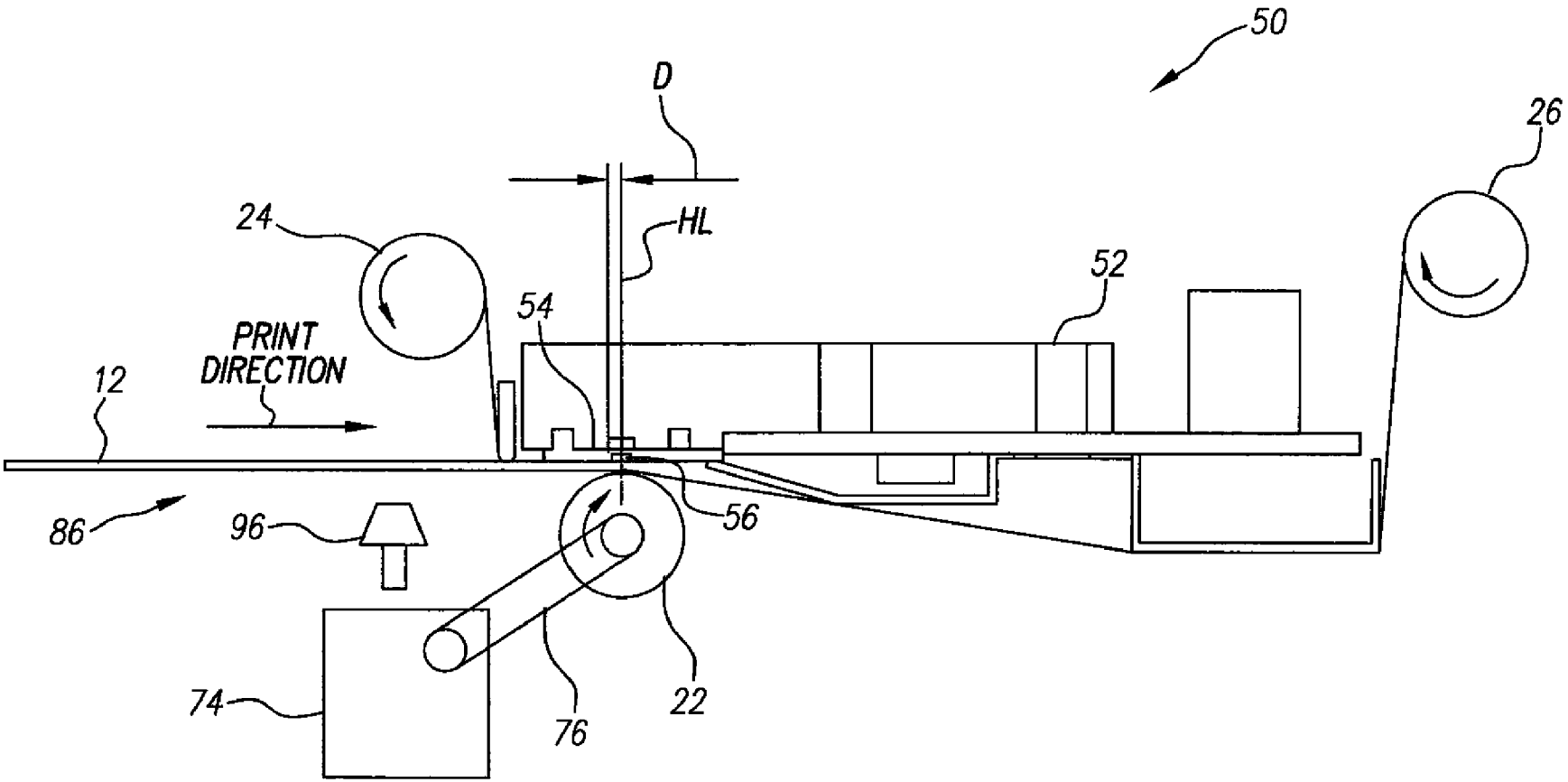
FIG. 3 is a mechanical schematic of a thermal printer showing the reversed direction of paper flow with regard to the printhead of FIG. 1.
Figure 4:
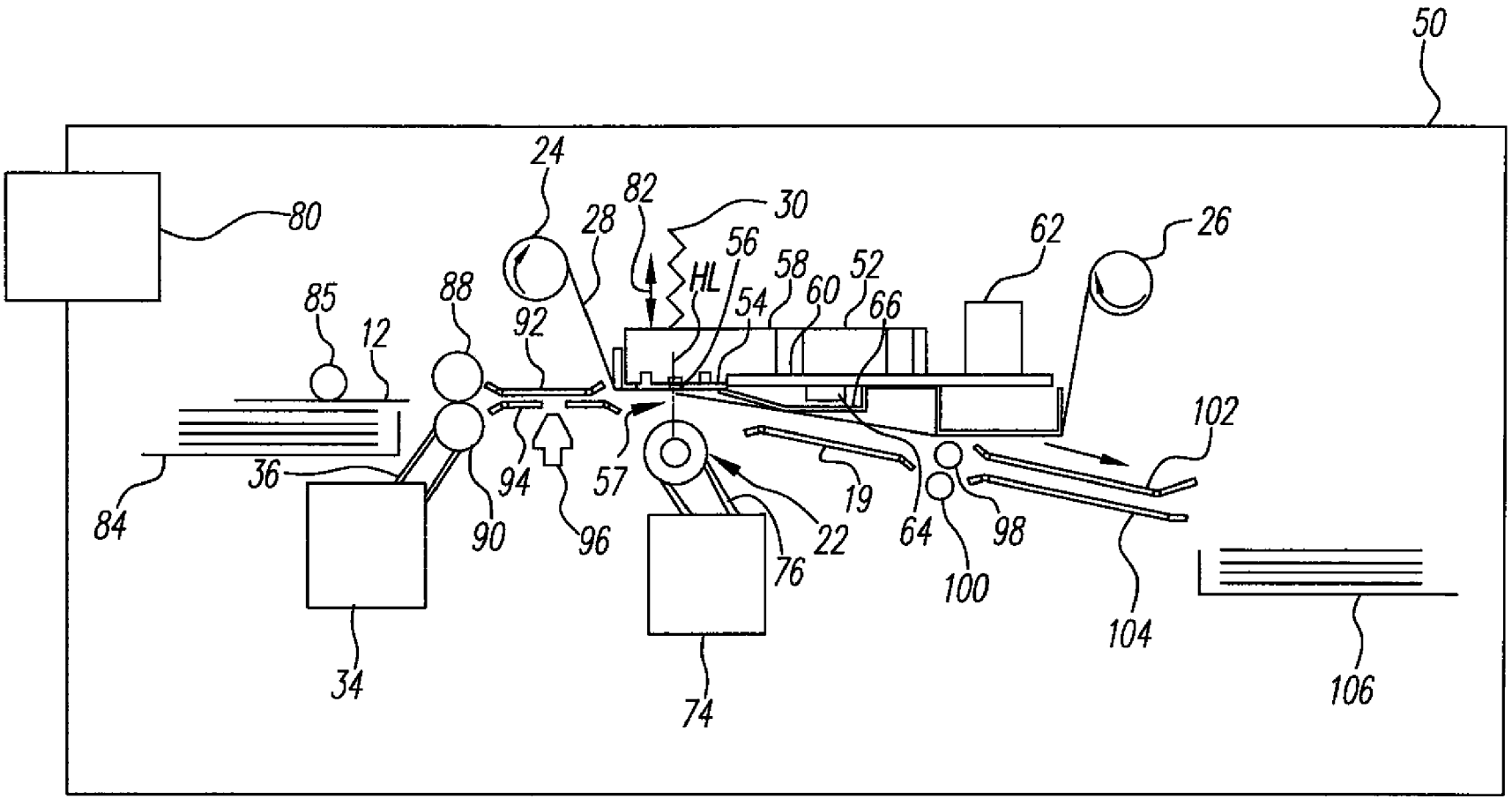
FIG. 4 is a mechanical schematic view of the printing apparatus with reversed flow direction.

Referring now to FIGS. 2, 3 and 4, there is shown a borderless thermal dye thermal printer 50 for printing images along the width and length of a receiver medium 12, such as for example, a paper, fabric or film. Printer 50 has a thermal printhead 52. Printhead 52 has a ceramic substrate 54 with a linear array of heating elements 56. An aluminum backer plate 58 is on the upper side of ceramic substrate 54 for dissipating heat generated in heating elements 56. In various embodiments, backer plate 58 can comprise a heat sink or can be connected to convey heat to a separate heat sink (not shown). Heating elements 56 are arranged along what is commonly known as a heat line HL or print line. The terms "linear array of heating elements", "heat line HL", and "print line" are used interchangeably in this patent and refer to any form or arrangement of heating elements 56 that extend generally across a printable area of receiver medium 12 as receiver medium 12 is moved past printhead 52.

Next to ceramic substrate 54 is a circuit board 60. On one side of circuit board 60 is a connector 62 for receiving power and data signals and on the other side an integrated circuit 64 that controls power to heating elements 56. Integrated circuit 64 is enclosed in a protective housing 66 that has a first end wall 68 and a second end wall 70, with a cover 72 between end walls 68 and 70, and two sidewalls (not shown). First end wall 68 is proximate ceramic substrate 54 and has a sloped surface that extends from ceramic substrate 54 to a height above integrated circuit 64. Second end wall 70 extends substantially transverse to circuit board 60. Cover 72 extends between end walls 68 and 70 and the sidewalls.

Thermal printhead 52 is oriented with ceramic substrate 54 facing toward the leading edge of receiver medium 12 as receiver medium 12 is moved during a printing operation. In the rest or non-printing position, substrate 54 and receiver medium 12 are arranged in substantially parallel, spaced-apart planes. During a printing operation thermal printhead 52 is moved relative to receiver medium 12 so that ceramic substrate 54 will cover and rest on top of web 28 of thermal dye transfer donor material and receiver medium 12.

A donor supply roller 24 on one side of thermal printhead 52 provides web 28 of thermal dye transfer donor material that travels across the linear array of heat elements 56 and is wound on a donor take-up roller 26. Web 28 of donor material can comprise a single color for monotone printing, but it typically comprises at least three sequential sections of different colors in order to provide full-color print and a clear section for applying a protective cover on the print. Beneath printhead 52 is a cylindrical platen 22. Platen 22 is coupled to a platen stepper motor 74 by a suitable platen transmission 76 such as a belt. Those skilled in the art understand that FIGS. 2-4 are schematic in nature and other suitable means are possible for connecting the platen stepper motor 74 to cylindrical platen 22 in order to turn platen 22. Such other means include and are not limited to gear trains. Thermal printhead 52 is coupled to control circuit 80. Control circuit 80 is coupled to a printhead actuator (not shown), such as a motor or solenoid and appropriate transmission that controls the position of thermal printhead 52 relative to platen 22. In operation, control circuit 80 operates the printhead actuator (not shown) in order to move thermal printhead 52 along the axis shown by arrow 82 so as to increase or decrease the size of a printing nip area 57.

In the embodiment of FIGS. 2-4, receiver medium 12 is stored in a hopper 84. The top sheet of receiver medium 12 from hopper 84 is removed from hopper 84 by a suitable pick roller 85. This receiver medium 12 travels along a heating first printer path 86 that leads it to guide rollers 88, 90, between surface guides 92, 94, past edge sensor 96, through printing nip area 57, past heat line HL to exit urge rollers 98, 100, exit guides 102, 104 and into exit hopper 106. Control circuit 80 is connected to the moveable and operative elements of printer 50 for controlling their individual and coordinated operation. Those skilled in the art understand that control circuit 80 is a schematic representation for a hard-wired controller or a processor controlled system that uses hardware and optionally software to control and operate printer 50 and its components.

Edge sensor 96 is any suitable sensor for identifying the leading edge of a receiver medium 12. Edge sensor 96 can be an optical, mechanical, or a combination optical/mechanical device that senses the leading edges of the receiver medium 12. Such sensors are well-known in printers and photocopiers and any suitable, conventional sensor may be used. In addition, edge sensor 96 may be combined with a suitable gate (not shown).

Those skilled in the art understand that when receiver medium 12 reaches edge sensor 96, receiver medium 12 has its lateral sides aligned and deskewed so that the leading edge of receiver medium 12 is transverse to heating first printer path of travel 86 and is substantially aligned parallel to the linear array of heating elements 56. Edge sensor 96 thus senses the position of the leading edge of receiver medium 12 at the location of edge sensor 96.

Edge sensor 96 is disposed at a known distance from heat line HL. Edge sensor 96 is coupled to control circuit 80. In response to edge sensor 96 detecting the leading edge of receiver medium 12, control circuit 80 drives urge stepper motor 34 a predetermined number of steps in order to move receiver medium 12 toward heating elements 56 and to stop receiver medium 12 with the leading edge at a distance D from heat line HL. The initial position is a distance D just short of the heat line HL and is close enough to the heat line HL that the lead edge of receiver medium 12 will be captured in the nip between web 28 and platen 22.

In the embodiment illustrated in FIGS. 2-4, receiver medium 12 is staged under the ceramic substrate 54 of thermal printhead 52 which has the advantage of allowing receiver medium 12 to traverse a relatively straight receiver medium path before it enters the printing nip 57 between printhead 52 and platen 22. A straight receiver medium path allows easier registration of receiver medium 12 during printing.

Receiver medium 12 is precisely positioned and repositioned by one or more of the stepper motors that operate the pairs of guide rollers 88, 90, and exit urge rollers 98, 100 and platen 22. In one embodiment, only platen 22 or one of the pairs of guide rollers 88, 90 move receiver medium 12 at any one time. Thus, the first pair of guide rollers, 88, 90, control movement of receiver medium 12 past edge sensor 96 to the initial position. Platen 22 then controls movement of receiver medium 12 beneath heating elements 56. Exit urge rollers 98, 100 control return of receiver medium 12 toward its initial position and its final discharge from printer 50. Exit urge rollers 98, 100 release control of receiver medium 12 after receiver medium 12 has been moved by a predetermined distance after printing is complete. Then exit urge rollers 98, 100 resume control to precisely reposition receiver medium 12 at the initial position that is within the distance D of heat line HL.

Control circuit 80 operates guide rollers 88, 90 to move the leading edge of receiver medium 12 into printing nip 57 between thermal printhead 52 and platen 22. Guide rollers 88, 90 can be permanently engaged or can be selectively engaged. To selectively engage guide rollers 88, 90, upper roller 88 can be spring biased away from guide roller 90 and an actuator (not shown) controlled by control circuit 80 is operable to move guide roller 88 into or out of engagement with guide roller 90. Exit urge rollers 98, 100 can be similarly constructed. If the guide rollers 88, 90 and exit urge rollers 98, 100 are permanently engaged, then they will be actuated as described above.

As discussed above, guide rollers 88, 90 drive receiver medium 12 to the initial position where a leading edge of receiver medium 12 is positioned at a distance D from the from heat line HL. After receiver medium 12 is in the initial position, control circuit 80 drives thermal printhead 52 downward in the direction of arrow 82 in order to clamp receiver medium 12 between printhead 52 and platen 22. With receiver medium 12 in place, control circuit 80 causes platen stepper motor 74 and thermal printhead 52 and its linear array of heating elements 56 to be selectively operated to transfer donor material, in particular thermal-dye transfer material, from donor web 28 to receiver medium 12.

After printing, the direction of donor web 28 and receiver medium 12 are sharply altered to separate donor web 28 from receiver medium 12. Receiver medium 12 continues to travel between exit guides 102, 104 and into the nip of exit urge rollers 98, 100. Exit urge rollers 98, 100 are likewise under control of control circuit 80. Exit urge rollers 98, 100 are optionally operable to rewind and feed receiver medium 12 back toward platen 22. Receiver medium 12 is rewound and fed back during multicolor printing. After a color or clear laminate is transferred to receiver medium 12, control circuit 80 stops receiver medium 12 at a position just past heating element 56. Control circuit 80 turns off heating elements 56 and causes printhead actuator (not shown) to raise thermal printhead 52 to release receiver medium 12 from printing nip area 57 between printhead 52 and platen 22. Next, control circuit 80 turns on exit urge rollers 98, 100 to drive receiver medium 12 back toward the printing nip area 57, or following the application of the last color or laminate, toward exit hopper 106.

Donor web 28 has multiple, sequential sections of different colors or a clear laminate and the single printing cycle described above is repeated for each color and for the clear laminate. A typical color print operation includes serial printing from section of yellow, magenta, cyan dyes and then transferring a clear, protective layer on receiver medium 12. After each color or clear section is printed, receiver medium 12 is returned to its initial position for printing the next color from the donor web. After multicolor printing is completed, exit urge rollers 98, 100 discharge receiver medium 12 into exit hopper 106.

It is valuable in a printer to be able to re-register receiver medium 12 between the printing of different colors. A receiver medium path which is straight and free of disruptions is desirable.

Accordingly, various embodiments of printer 50 achieve borderless printing on a single sheet by precisely locating the leading edge of receiver medium 12 and, in particular, locating the leading edge precisely between heating elements 56 and platen 22 both initially and at the beginning of printing of each new color if any. Edge sensor 96 senses the leading edge during the location process. Stepper motors precisely drive sets of guide rollers 88, 90 and platen 22 to precisely position receiver medium 12 at its initial position for each printing cycle. In this way, thermal-dye transfer material may be transferred from the leading edge of receiver medium 12 to the trailing edge of the paper, thereby eliminating any border on the leading and trailing edges.

Figure 5:
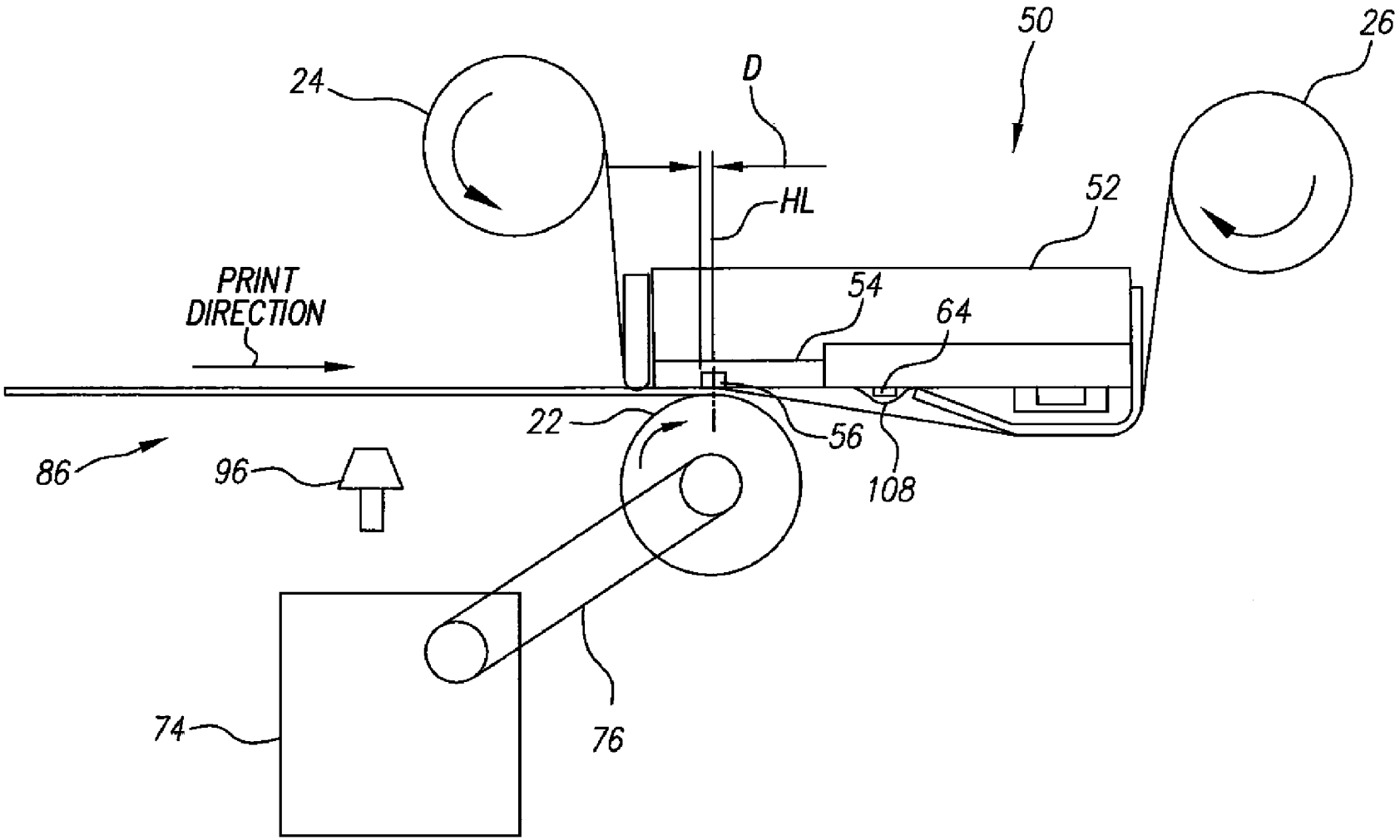
FIG. 5 is a mechanical schematic view of another embodiment of a printer having a printhead with resin encased integrated circuits and reversed flow direction.

As is illustrated in FIG. 5, in certain embodiments, printer 50 can have a printhead 52 with an integrated circuit 64 positioned on an outside of printhead 52, but protected by a deposit 108 of a protective material, such as a coating of resin. As can be seen in FIG. 5, printer 50 provides a generally a straight and unbent heating first printer path 86 leading to heating elements 56.

Accordingly, a printer is provided that reverses the direction of receiver medium movement past printhead 52 from the conventional direction (from circuit board to ceramic head) to the reversed direction (from ceramic head to circuit board) in order to reduce any bends in the path of the receiver medium in advance of printing. In particular, a leading edge of receiver medium 12 passes the heat line HL before passing the integrated circuit 64 and any protective structure associated therein, such as housing 66, or deposit 108. This removes the integrated circuit and such protective structure from the path of the leading edge of the unprinted receiver medium 12 to provide an uninterrupted path as receiver medium 12 travels to the heat line HL.

The invention has been described in detail with particular reference to certain preferred embodiments thereof, but it will be understood that variations and modifications can be effected within the spirit and scope of the invention.

PARTS LIST

10 conventional printer
12 receiver medium
14 print path
16 capstan roller
18 pinch roller
20 printhead
22 platen
24 donor supply roller
26 donor take up roller
28 donor web
30 bias spring
32 pinch spring
34 stepper motor
36 belt

38 nip
40 cover
50 printer
52 thermal printhead
54 ceramic substrate
56 heating elements
57 printing nip area
58 backer plate
60 circuit board
62 connector
64 integrated circuit
66 housing
68 first end wall
70 second end wall
72 cover
74 platen stepper motor
76 platen belt
80 control circuit
82 arrow
84 hopper
85 pick roller
86 heating first printer path
88 guide roller
90 guide roller
92 surface guide
94 surface guide
96 edge sensor
98 exit urge roller
100 exit urge roller
102 exit guide
104 exit guide
106 exit hopper
108 deposit
D distance
HL heat line

The invention claimed is:

1. A method for operating a printer having a printhead moveable toward and away from a platen, the printhead comprising a ceramic substrate for holding a plurality of heating elements and an integrated circuit laterally spaced from the ceramic substrate and connected to the heating elements for selectively operating the heating elements, the method comprising the steps of:

moving the receiver medium along the path toward the printhead and the platen;

moving the printhead toward the platen to clamp the receiver medium between the platen and a web of thermal donor material;

moving the platen with respect to the printhead to advance the receiver medium and the donor web past the printhead in a direction where the donor web and receiver medium pass the ceramic substrate and thereafter pass the integrated circuit; and selectively energizing portions of the printhead to transfer donor material from the donor web to the receiver medium during said movement.

2. The method of claim 1, wherein the donor web has three serial sections of different colors to provide full color printing, the donor web has one color section positioned for printing a first color on the receiver medium, and further comprising the steps of:

moving the printhead away from the donor web to release the receiver medium;

advancing the donor web to the second color section;

returning the receiver medium to said initial position; and repeating the subsequent steps of claim 1 to print a second color on the receiver medium.

3. The method of claim 2, comprising the further step of advancing the donor web to the third color section and repeating the subsequent steps of claim 2.

4. The method of claim 1, wherein the platen moves the receiver medium in steps.

5. A printer for printing using a donor web and a receiver medium, said printer comprising:

a donor web and a receiver medium for printing;

a printhead moveable toward and away from a platen, the printhead comprising a ceramic substrate for holding a plurality of heating elements and an integrated circuit laterally spaced from the ceramic substrate and connected to the heating elements for selectively operating the heating elements;

said receiver medium being positioned between the printer and the platen, said donor web disposed between the printhead and the receiver medium;

a sheet feeder for moving the receiver medium toward the platen to register the receiver medium with the donor web; and a motor coupled to the platen for operating the platen to drive the receiver medium and the donor web during printing in a direction from the ceramic substrate toward the integrated circuit.

6. The printer of claim 5, further comprising a donor web supply roll and a donor web take-up roll wherein the donor web travels along a path during printing from the donor supply roll to the donor take-up roll and the web passes the ceramic substrate before and subsequently passes the integrated circuit.

7. The printer of claim 5, wherein the integrated circuit is enclosed in a protective housing that has a two walls and a cover between the walls, with one wall distal from the ceramic substrate and transverse to the substrate and the other wall proximate the ceramic substrate and varying in height from a minimum level proximate the level of the substrate to a maximum level of the cover.

8. A printer comprising:

a printhead moveable toward and away from a platen, the printhead comprising a ceramic substrate for holding a plurality of heating elements and an integrated circuit laterally spaced from the ceramic substrate and connected to the heating elements for selectively operating the heating elements;

a donor web disposed between the printhead and the platen;

a transport path shaped to guide receiver medium toward the platen to register the receiver medium between the donor web and the platen; and a motor to move the platen; and a control circuit to cause the motor to advance the receiver medium and the donor web along the transport path during printing in a direction from the ceramic substrate toward the integrated circuit.

9. The printer of claim 8, wherein said control circuit selectively energizes portions of the printhead to transfer donor material from the donor web to the receiver medium during printing.

10. The printer of claim 8, wherein the integrated circuit is enclosed in a protective housing that has a two walls and a cover between the walls, with one wall distal from the ceramic substrate and transverse to the substrate and the other wall proximate the ceramic substrate and varying in height from a minimum level proximate the level of the substrate to a maximum level of the cover.

11. The printer of claim 8, wherein the receiver medium is in sheet form.

12. The printer of claim 8, further comprising a donor web supply roll and a donor web take-up roll wherein the donor web travels along a path during printing from the donor supply roll to the donor take-up roll and the web passes the ceramic substrate and thereafter passes the integrated circuit.

13. A thermal printer comprising:

a printhead adapted to heat a thermal donor medium to transfer donor material from a donor web to a receiver medium;

a receiver medium path having guides shaped to direct receiver medium along a receiver medium travel path to and from a position in registration with the printhead with said receiver medium path having at least one change of receiver medium direction therein causing said receiver medium to bend; and a motorized platen for moving receiver medium through the receiver medium path, wherein said receiver medium path is further shaped so that the change in receiver medium direction occurs in a portion of the receiver medium path that takes the receiver medium from a position in registration with the printhead.

* * * * *